US008506348B2

(12) United States Patent
Hu

(10) Patent No.: US 8,506,348 B2
(45) Date of Patent: Aug. 13, 2013

(54) BREAST ENHANCING BRASSIERE

(75) Inventor: Xiao Qing Hu, New York, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 530 days.

(21) Appl. No.: 12/782,156

(22) Filed: May 18, 2010

(65) Prior Publication Data

US 2011/0287691 A1 Nov. 24, 2011

(51) Int. Cl.
*A41C 3/00* (2006.01)

(52) U.S. Cl.
USPC ..... 450/54; 450/39; 450/57

(58) Field of Classification Search
USPC ..... 450/36–39, 54–57; 2/267, 268
See application file for complete search history.

(56) References Cited

U.S. PATENT DOCUMENTS

| | | | | |
|---|---|---|---|---|
| 2,420,472 | A * | 5/1947 | Freedman | 450/54 |
| 3,568,681 | A * | 3/1971 | Comollo | 450/54 |
| 5,098,330 | A * | 3/1992 | Greenberg | 450/55 |
| 5,334,082 | A | 8/1994 | Barker | |
| 6,231,423 | B1 * | 5/2001 | Deal et al. | 450/57 |
| 6,431,945 | B1 * | 8/2002 | Stephens et al. | 450/37 |
| 6,544,100 | B1 | 4/2003 | Nadsady et al. | |
| 6,811,464 | B2 | 11/2004 | Li | |
| 6,824,444 | B2 | 11/2004 | Huang | |
| 7,074,108 | B2 | 7/2006 | Knox | |
| 7,666,059 | B2 | 2/2010 | Falla et al. | |
| 2009/0061731 | A1 * | 3/2009 | Redenius | 450/39 |

FOREIGN PATENT DOCUMENTS

FR 2911478 A1 7/2008

OTHER PUBLICATIONS

International Search Report and Written Opinion of the International Searching Authority, European Patent Office, Jose Mendo Perez, Jul. 19, 2011.

International Search Report and Written Opinion of the International Searching Authority for PCT/US2011/032116, European Patent Office Jose Mendo Perez, Jul. 19, 2011.

* cited by examiner

*Primary Examiner* — Gloria Hale
(74) *Attorney, Agent, or Firm* — Womble Carlyle Sandridge & Rice LLP; Jeffrey R. McFadden

(57) ABSTRACT

A brassiere is provided having a pair of breast-receiving cups, each cup comprising at least one fabric layer molded to at least one foam layer, and an inner breast-receiving side and a lower periphery and an upper periphery. A first shaped pocket is formed on the breast-receiving side having a slit formed therein. A first shaped cushion conforming substantially to the shape of the pocket is removably insertable into the pocket to provide breast enhancement to a wearer.

16 Claims, 8 Drawing Sheets

BREAST ENHANCING BRASSIERE

FIELD OF THE INVENTION

The present invention relates to the field of women's undergarments, and, in particular, to a brassiere having breast-receiving cups with removable cushion inserts to enhance the shape of the breasts when the brassiere is worn.

BACKGROUND OF THE INVENTION

Brassieres designed for shaping, lifting, and enhancing the appearance of a woman's breasts are well known in the intimate apparel arts. Brassieres having padding or other cushioning materials sandwiched between layers of fabric material at the lower portions of the breast-receiving cups are sometimes worn by women who desire to enhance their appearance and/or accent their cleavage without resorting to surgical procedures.

Numerous attempts have been made to advance the art of breast enhancement; most, however, have been minimally effective, i.e., they have resulted in an artificial look and/or are uncomfortable when the brassiere is worn. Unfortunately also, the enhancement brassieres currently known in the art incorporate similarly-dimensioned padding, cushions, gel packs, etc. into both of the brassiere breast-receiving cups, typically on the lower portion of each breast-receiving cup. Thus, while a brassiere so constructed may fit perfectly for some women, a "one-size-fits-all" approach frustrates many wearers by providing either too little or too much lift and enhancement.

Additionally, for women having unevenly sized breasts, which account for a significant portion of the population, wearing a brassiere where both breast-receiving cups are identically dimensioned provides unacceptable results.

While numerous, and some costly, solutions to address these problems have been devised, none addresses the problems of providing the desired degree of enhancement and accommodating unevenly sized breasts, while at the same time providing an aesthetically pleasing appearance when the brassiere is worn and that can be manufactured at a relatively low cost.

SUMMARY OF THE INVENTION

The present invention is directed to a breast-enhancing brassiere comprising a pair of breast-receiving cups, with each cup including at least one cushioned layer having an inner breast contacting side and an outer side, at least one outer fabric layer affixed to the outer side of the cushioned layer, and an inner breast-contacting side having a lower periphery and an upper periphery. A first pocket is formed on the breast-receiving side and has a slit formed therein. A first cushion conforming substantially to the shape of the pocket is removably insertable into the pocket, wherein the first cushion provides breast enhancement to the wearer of the brassiere.

In one embodiment, the first cushion has a geometric center with a thickness that is greater than the thickness at the outer edges of the cushion. Another exemplary embodiment comprises a second cushion that is smaller than, and substantially conforming to the shape of, the first cushion and also is removably insertable into a pocket in the first cushion to provide additional breast enhancement to the wearer.

Various features and aspects of the invention will become apparent upon review of the detailed description set forth below when taken in conjunction with the accompanying drawings, which are briefly described as follows.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications, and improvements are within the scope of the present invention.

Figure 1:
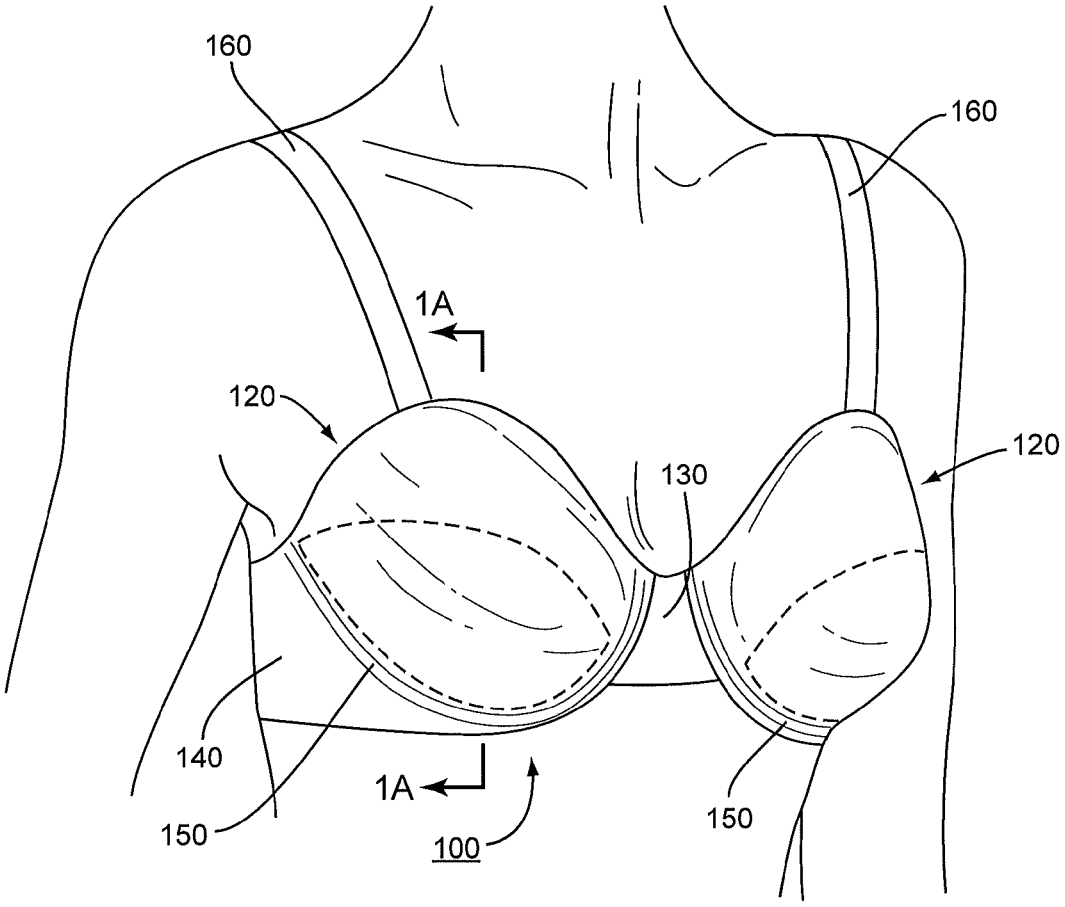
FIG. 1 is a front perspective, environmental view of a breast-enhancing brassiere formed according to the present invention.

Referring to FIG. 1, the present invention is directed to a breast enhancing brassiere, shown generally as 100. The breast enhancing brassiere 100 comprises a pair of breast-receiving cups 120, a pair of torso encircling bands 140. Each torso encircling band 140 extends outwardly from a breast-receiving cup 120. The brassiere 100 also includes a pair of shoulder straps 160, with a shoulder strap 160 extending between one of the breast receiving cups 120 and one of the torso encircling bands 140. Alternatively, the breast enhancing brassiere may be strapless. In one exemplary embodiment, the brassiere 100 may comprise a centrally-located gusset 130 interconnecting the pair of breast-receiving cups 120.

Figure 2:
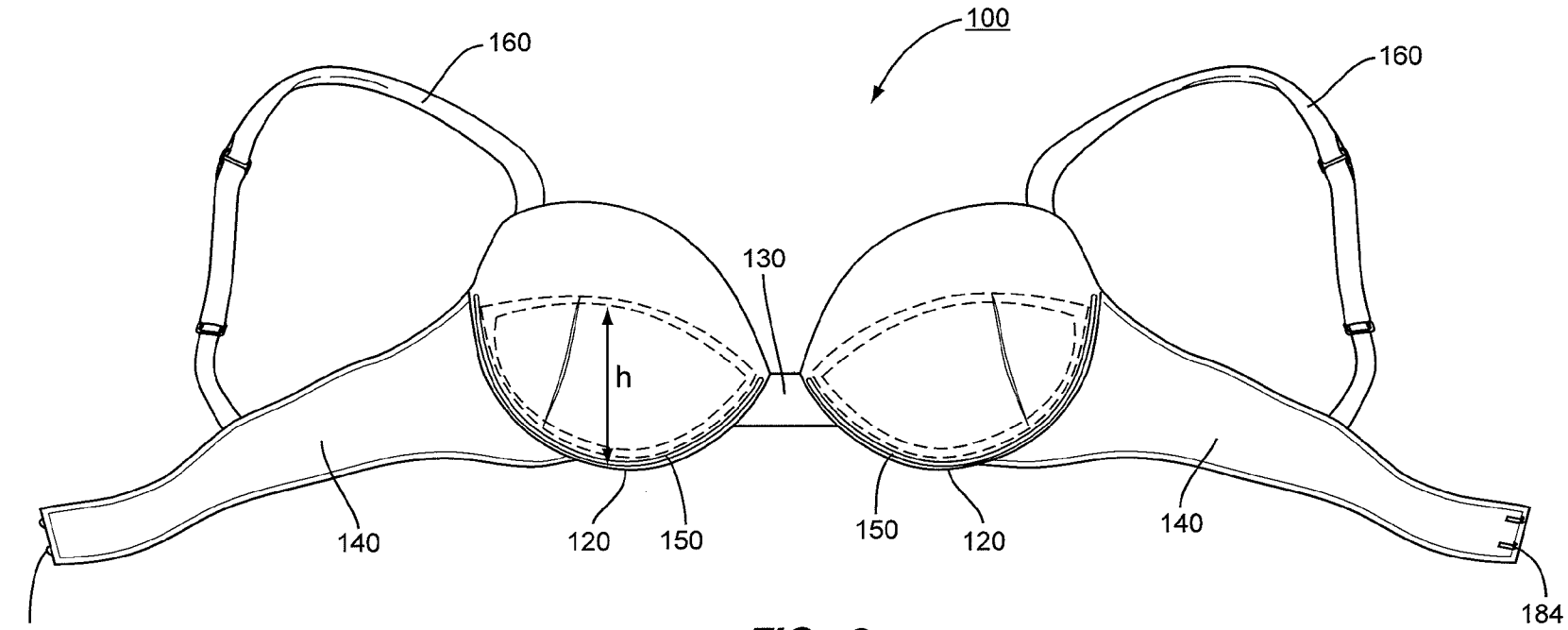
FIG. 2 is a rear perspective view of the brassiere of FIG. 1, illustrating the shape and placement of the pocket for insertion of a cushion therein.

As best shown in FIG. 2, the torso-encircling bands 140 will encircle the wearer's torso and interconnect at the back of the wearer with any conventional closure means 184, such as a hook and eye closure, hook and loop closure, etc. Alternatively, the brassiere 100 may comprise a front closure (not shown) in lieu of a central gusset 130, or may comprise a continuous band without any back or front closure means in the case of a pullover, or sports-type brassiere construction. The torso-encircling band portions 140 and the shoulder straps 160 may be formed of conventional single or multilayer fabrics cotton, polyester, nylon, rayon, elastomerics, etc., natural and synthetic, and combinations thereof.

Figure 3:
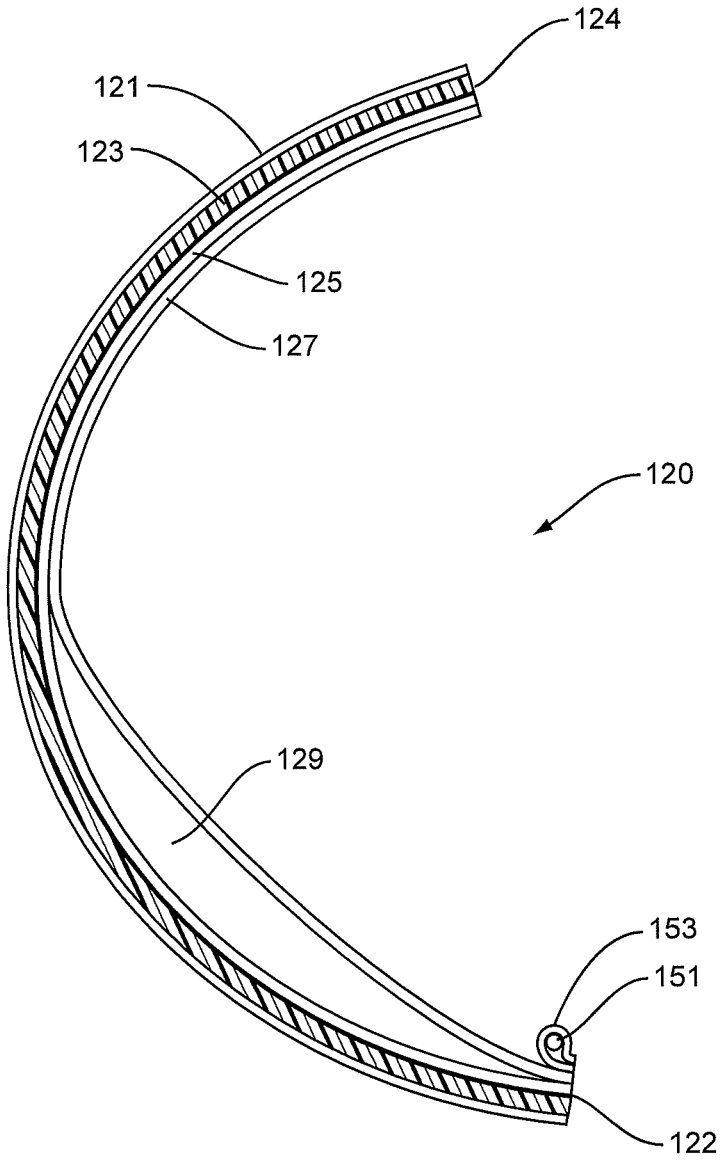
FIG. 3 is a sectional view of the brassiere of FIG. 1, taken along Line 1A-1A.

Referring to FIG. 3, a cross-sectional view of a breast-receiving cup 120 is shown in detail. In the embodiment shown, each breast-receiving cup 120 comprises at least one fabric outer layer 121, which is affixed to at least one cushioned layer 123 of lofted material. As used herein, the term "lofted material" includes foam, circularly knitted and/or warp knitted single ply materials or combination of materials, including batting, spacer fabric, etc., and fiberfill. In one exemplary embodiment, the fabric outer layer 121 may be laminated to the cushioned layer 123 of lofted material by a conventional molding process. This cup 120 also comprises an inner fabric layer 125 that is laminated during the molding process to the layer 123 of lofted material, which in turn may be laminated to a inner fabric layer 125. The fabric layers may be formed from any of the commonly known yarns and fibers including, but not limited to, cotton, polyester, nylon, rayon, elastomerics, etc., natural and synthetic, and combinations thereof. The method of laminating multiple layers of varying types of materials is well known in the art. The cushioned layer 123 may be any of the conventionally known foam materials, such as polyurethane, high density, latex rubber, etc.

As best shown in FIGS. 2 and 3, a first cushion pocket 129 is formed over the inner breast contacting surface of the breast-receiving cup 120, closest to a wearer's skin. The first cushion pocket 129 may be substantially oval shaped and comprises a first fabric layer 127. The fabric layer 127 is affixed about the lower periphery 122 of the breast-receiving cup 120 and extends upwardly to a height "h" that is spaced apart from the upper periphery 124 of breast-receiving cup 120. Extending upwardly from height "h", the fabric layer 127 is affixed or laminated to a second fabric layer 125. Alternatively, the fabric layer 127 may be shaped so that it ends at height "h" and is stitched or bonded to the inner fabric layer 125. Below height 'h', the fabric layer 127 is unattached except at the lower periphery 122. The fabric layers 125 and/or 127 then form a substantially oval shaped pocket 129. As used herein, the phrase "substantially oval," refers to any oval shape including, but not limited to, an oval, an ellipse, a football shape, or a vesica piscis, where the upper and lower curved edges meet at either rounded or pointed, opposed ends.

Figure 4:
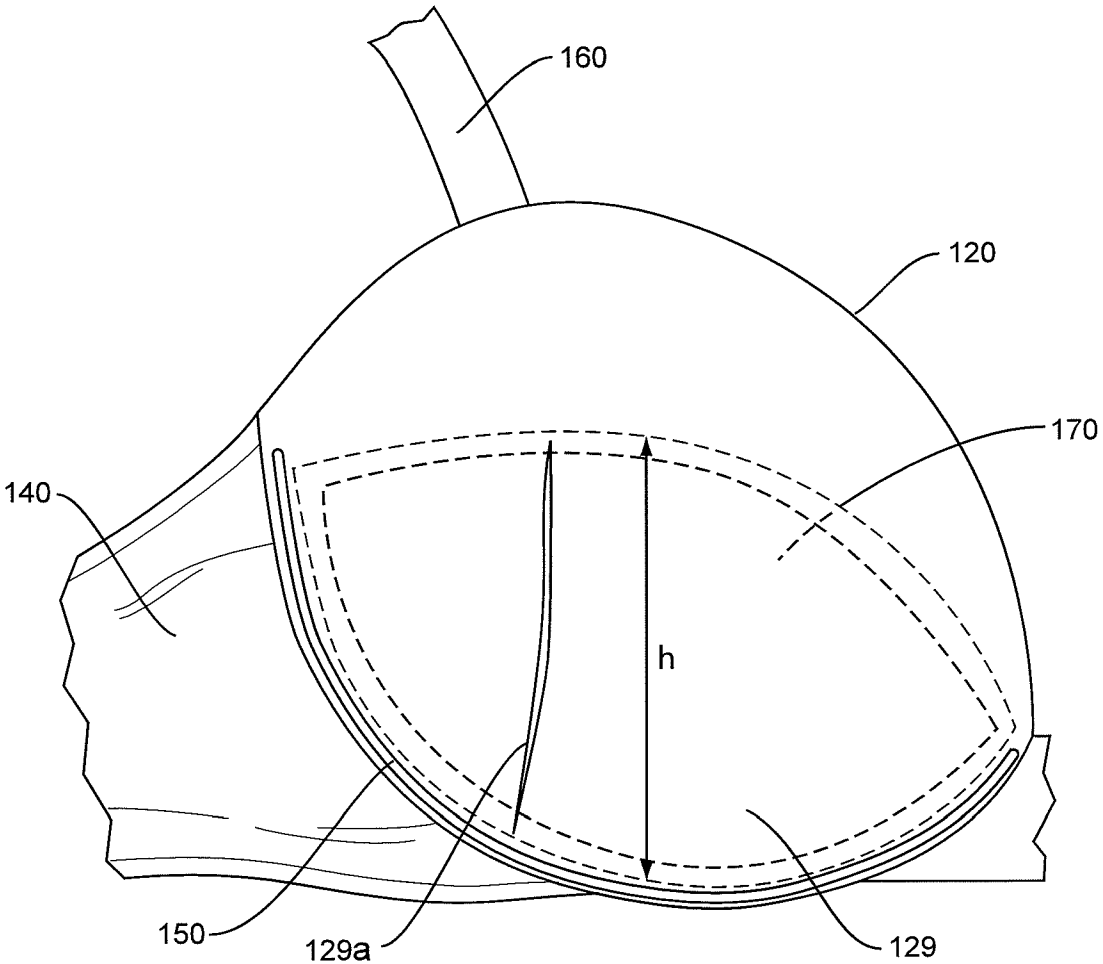
FIG. 4 is a close-up view of the left brassiere cup of FIG. 2, illustrating the placement of the slit formed in the pocket for insertion of a cushion.

As best shown in FIG. 4, a slit 129*a* is formed in the fabric layer 127 so that a cushion insert, described in greater detail below, may be readily inserted into the pocket 129. In one embodiment, the slit 129*a* is substantially vertical. When there is no cushion insert in the pocket 129, the fabric layer 127 may lay substantially parallel to the inner surface of the breast-receiving up 120. Thus, the fabric layer 127 may have some elastic properties so that it will be somewhat taut and will not sag or bunch up within the breast-receiving cup 120 when worn. This means that the brassiere 100 is completely functional for wear and support of the breasts when the wearer desires no additional breast enhancement.

In the embodiment shown, to provide even further support, an underwire element 151 may be encased in a fabric cover 153, which is affixed about the lower periphery 122 of each breast receiving cup 120. The underwire element may be a flat or rounded rigid or semi-rigid plastic or metal. The fabric cover may be formed from any suitable material that provides suitable cushioning for the underwire and comfort to the wearer. In the embodiment shown, the fabric cover 153 is stitched to fabric layer 127 forming the pocket 129.

Figure 5A:
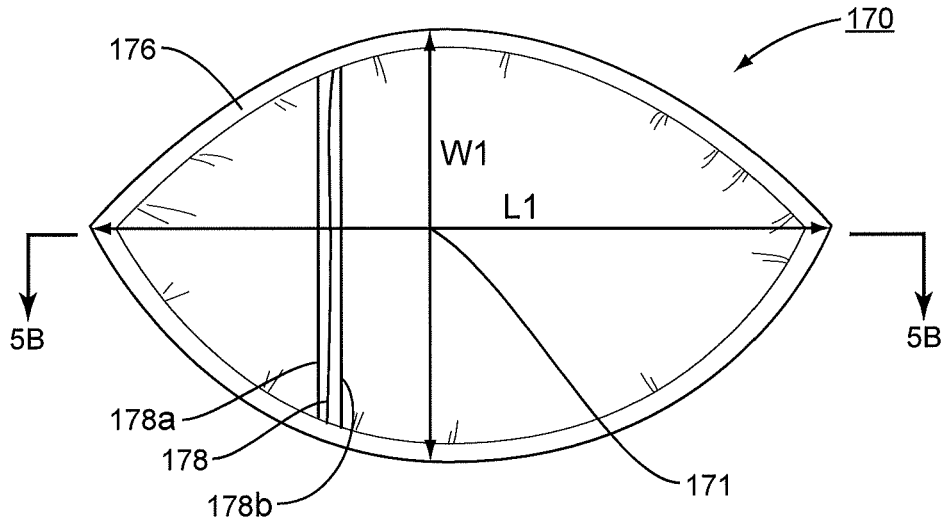
FIG. 5A is an elevational view of a first cushion insert.
Figure 5B:
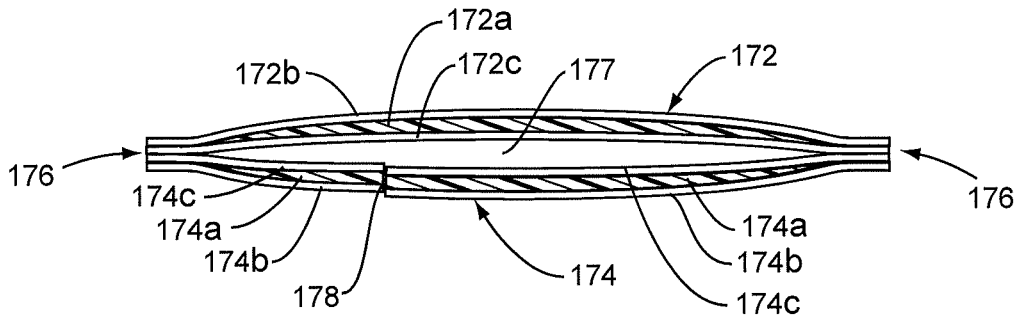
FIG. 5B is the elevational view of a second cushion insert.

Turning now to FIGS. 5A through 6B, the breast-enhancing cushions 170, 180 are illustrated. As shown in FIGS. 5A and 5B, a first cushion 170 is formed in the general shape and dimension of the pocket 129, the cushion 170 being slightly smaller so that it will readily fit into the pocket 129. The cushion 170 may be substantially oval shaped. As shown in FIG. 5B, the first cushion 170 comprises a first cushion portion 172 comprising a lofted layer 172*a* sandwiched between fabric layers 172*b* and 172*c*, and a second cushion portion 174 that is sandwiched between fabric layers 174*b* and 174*c*. The lofted and fabric layers used to form the cushion portions 172 and 174 may be the same as those used to construct the layers of the breast-receiving cup 120. The cushion portions 172, 174 may be attached to each other by stitching or bonding along an entire peripheral edge 176, forming another inner pocket, having a volume 177. The first cushion 170 further comprises a geometric center 171, a length It along its long axis, and a width 'W1' along its short axis. The geometric center 171 of the first cushion 170 may have a thickness that is greater than the thickness at the outer peripheral edge 176, i.e., the thickness decreases from the geometric center 171 outwardly to the peripheral edge 176. In one embodiment, the geometric center has a thickness of between about 0.30 inches and 0.35 inches, tapering outwardly to a thickness at the peripheral edge 176 of between about 0.15 inches and 0.17 inches. When constructed with a tapering thickness, a more natural look and shape is created for each breast.

If additional breast enhancement is desired, or alternatively, where the wearer has unevenly sized breasts and requires additional cushioning and/or lift for one or both breasts, the first cushion 170 may comprise a slit 178 formed through and along the short, or width 'W1' axis, of one of the first or second cushion portions 172, 174. The slit 178 may be a substantially vertical slit. Hems 172*a*, 172*b*, or alternatively 174*a*, 174*b*, are formed along the vertical slit 178 to facilitate inserting a second cushion 180 into the inner volume 177.

Figure 6A:
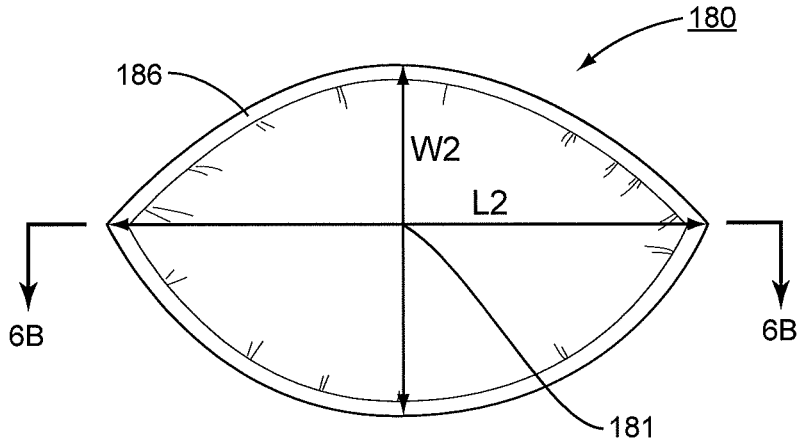
FIG. 6A is a cross-sectional view of the first cushion insert along its long axis.
Figure 6B:
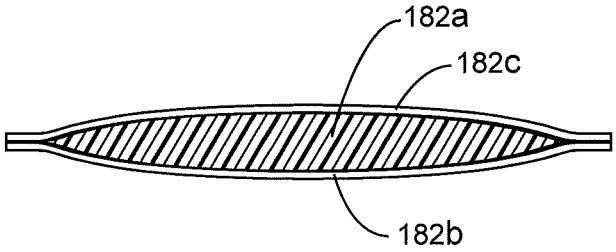
FIG. 6B is a cross-sectional view of the second cushion insert along its short axis.

Cushion 180 has a similar oval shaped geometry and is dimensioned for insertion through slit 178 into the inner volume 177 of cushion 170. As shown in FIGS. 6A and 6B, cushion 180 comprises a foam layer 182*a* that is sandwiched between fabric layers 182*b* and 182*c*. The second cushion 180 also comprises a geometric center 181, a length 12' along its long axis, and a width 'W2' along its short axis. The geometric center 181 of the second cushion 180 also has a thickness that is greater at the geometric center 181 than the thickness of the cushion 180 at the outer periphery 186. In one embodiment, the geometric center has a thickness of between about 0.17 inches 0.19 inches, tapering outwardly to a thickness at the peripheral edge 176 of between about 0.10 inches and 0.11 inches. The greater thickness at the geometric centers of the cushions 170, 180 creates a more natural look and shape of each breast when the brassiere 100 is worn.

Figure 7A:
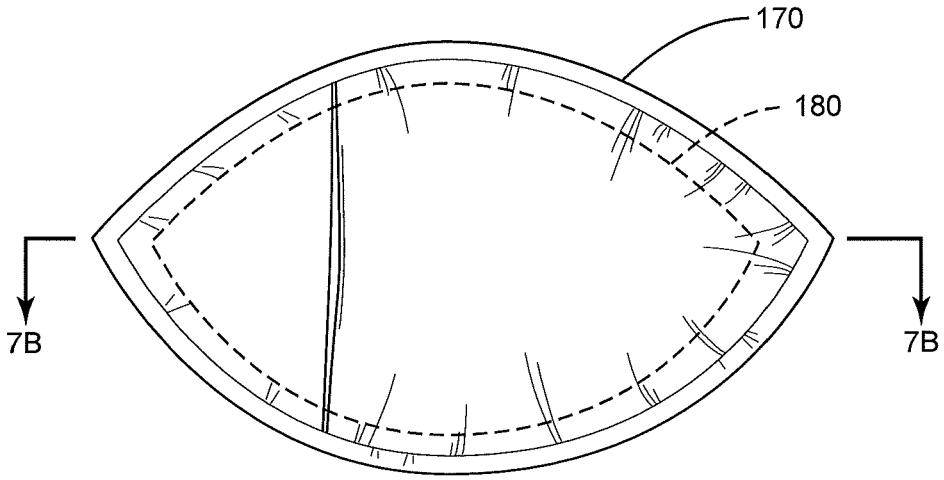
FIG. 7A is an elevational view of a second cushion inserted within a first cushion.
Figure 7B:
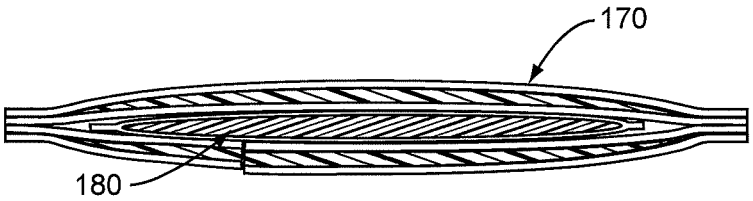
FIG. 7B is a cross-sectional view of a second cushion inserted within a first cushion.

Turning to FIGS. 7A and 7B, a composite cushion is shown, with the second cushion 180 inserted within the first cushion 170. As shown in FIG. 7B, the combination of the first and second cushions 170, 180 increases the thickness of the cushioning, providing additional breast enhancement to the wearer.

Figure 8A:
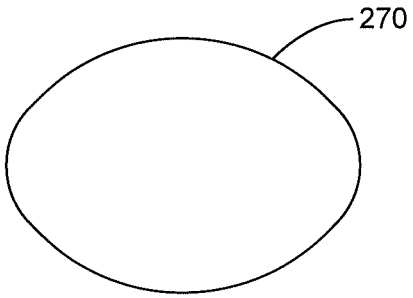
FIG. 8A is an alternative embodiment of a first or second cushion.
Figure 8B:
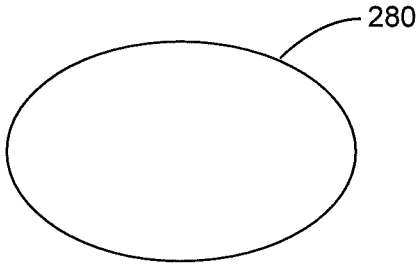
FIG. 8B is another alternative embodiment of a first or second cushion.

Although the Figures illustrate cushions 170, 180 as being substantially oval with pointed edges, i.e., vesica piscis, the present invention is not limited thereto. Rather, as described above, the cushions may have a variety of oval shapes, including, but not limited to exemplary embodiments such as those shown in FIGS. 8A and 8B, FIG. 8A illustrating an exemplary oval 270 having rounded ends, and FIG. 8B illustrating an ellipse 280.

Although the present invention has been described with an exemplary embodiment, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A breast enhancing brassiere, comprising:

(a) a pair of breast-receiving cups, each cup comprising:

at least one cushioned layer having an inner breast contacting side and an outer side, and having at least one outer fabric layer affixed to the outer side of the at least one cushioned layer;

the inner breast-contacting side having a lower periphery and an upper periphery;

a pocket formed on the breast-contacting side and having a slit formed therein, the pocket having elasticity to receive varying breat enhancement cushions; and (b) a first breast enhancement cushion conforming substantially to the shape of the pocket, the first cushion being removably insertable into the pocket, and formed to accommodate the placement of a second breast enhancement cushion within the pocket.

2. The brassiere of claim 1, wherein the at least one outer fabric layer is molded with the at least one cushioned layer.

3. The brassiere of claim 1, wherein the pocket is substantially oval-shaped.

4. The brassiere of claim 1, wherein the pocket is formed of an innermost fabric layer attached around at least a portion of the inner breast-contacting side.

5. The brassiere of claim 1, wherein the pocket extends upwardly from the lower periphery of each cup to a height spaced from the upper periphery.

6. The brassiere of claim 1, wherein the slit formed in the pocket is substantially vertical.

7. The brassiere of claim 1, wherein the first cushion is substantially oval-shaped.

8. The brassiere of claim 7, wherein the first oval-shaped cushion comprises:

a first cushion portion having an outer periphery;

a second cushion portion having an outer periphery; and the first and second cushion portions are attached about their outer peripheries and define a second pocket therebetween.

9. The brassiere of claim 8, wherein at least one of the first and second cushion portions comprises:

an outer fabric layer;

an innermost fabric layer; and a lofted material layer therebetween the outer fabric layer and the innermost fabric layer.

10. The brassiere of claim 9, wherein the lofted material layer is selected from the group consisting of foam, circularly knitted single ply material, warp knitted single ply material, batting spacer fabric, fiberfill, and combinations thereof.

11. The brassiere of claim 8, further comprising a slit formed in one of the first cushion portion and the second cushion portion.

12. The brassiere of claim 11, wherein the slit is substantially vertical.

13. The brassiere of claim 8, wherein the second cushion conforms substantially to the shape of the second pocket, the second cushion being removably insertable into the second pocket.

14. The brassiere of claim 7, wherein the first substantially oval-shaped cushion comprises a geometric center, a length along a long axis, a width along a short axis, and has a thickness at the geometric center that is greater than the thickness at the outer periphery.

15. The brassiere of claim 14, wherein the thickness at the geometric center is between about 0.3 inches and 0.35 inches, and the thickness at the outer periphery is between about 0.15 inches and 0.17 inches.

16. The brassiere of claim 1, further comprising an inner fabric layer affixed to an inner side of the at least one cushioned layer.

* * * * *